United States Patent [19]

Fisher et al.

[11] 4,328,076

[45] May 4, 1982

[54] ELECTRODE AND SLUDGE COLLECTOR SUPPORT DEVICE AND ELECTROPLATING THEREWITH

[75] Inventors: Gordon L. Fisher, Mahwah; Joseph V. Makely, Ramsey, both of N.J.

[73] Assignee: The International Nickel Co., Inc., New York, N.Y.

[21] Appl. No.: 183,628

[22] Filed: Sep. 2, 1980

[51] Int. Cl.[3] ..... C25D 17/12

[52] U.S. Cl. ..... 204/14 R; 204/45 R; 204/49; 204/279; 204/282; 204/283; 204/286

[58] Field of Search ..... 204/286, 282, 283, 14 R, 204/45 R, 49, 279

[56] References Cited

U.S. PATENT DOCUMENTS 3,223,611 12/1965 Wells et al. ..... 204/283 X 4,059,493 11/1977 Rice ..... 204/14 R

*Primary Examiner*—G. L. Kaplan

*Attorney, Agent, or Firm*—Raymond J. Kenny; Ewan C. MacQueen

[57] ABSTRACT

An electrode and sludge collector support device is provided which permits the immersing of electrode and sludge collector into an electrolytic plating bath and which permits the removal of spent electrodes and subsequent replacement of electrodes without the removal of the sludge collector from the bath.

8 Claims, 8 Drawing Figures

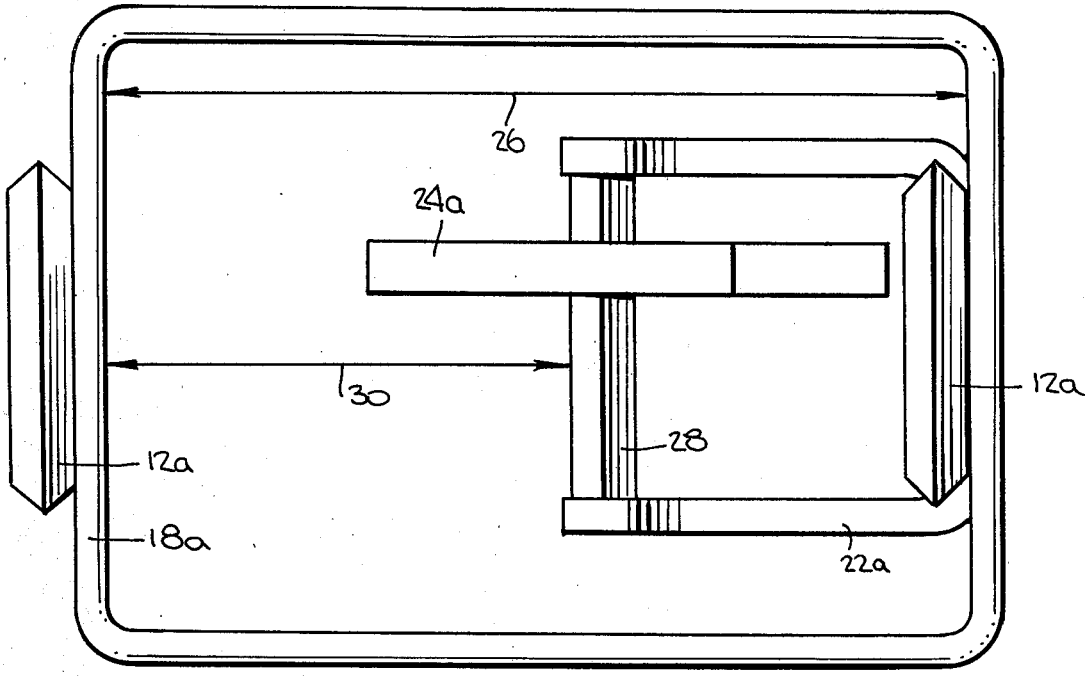
Fig. 2.
Fig. 3.
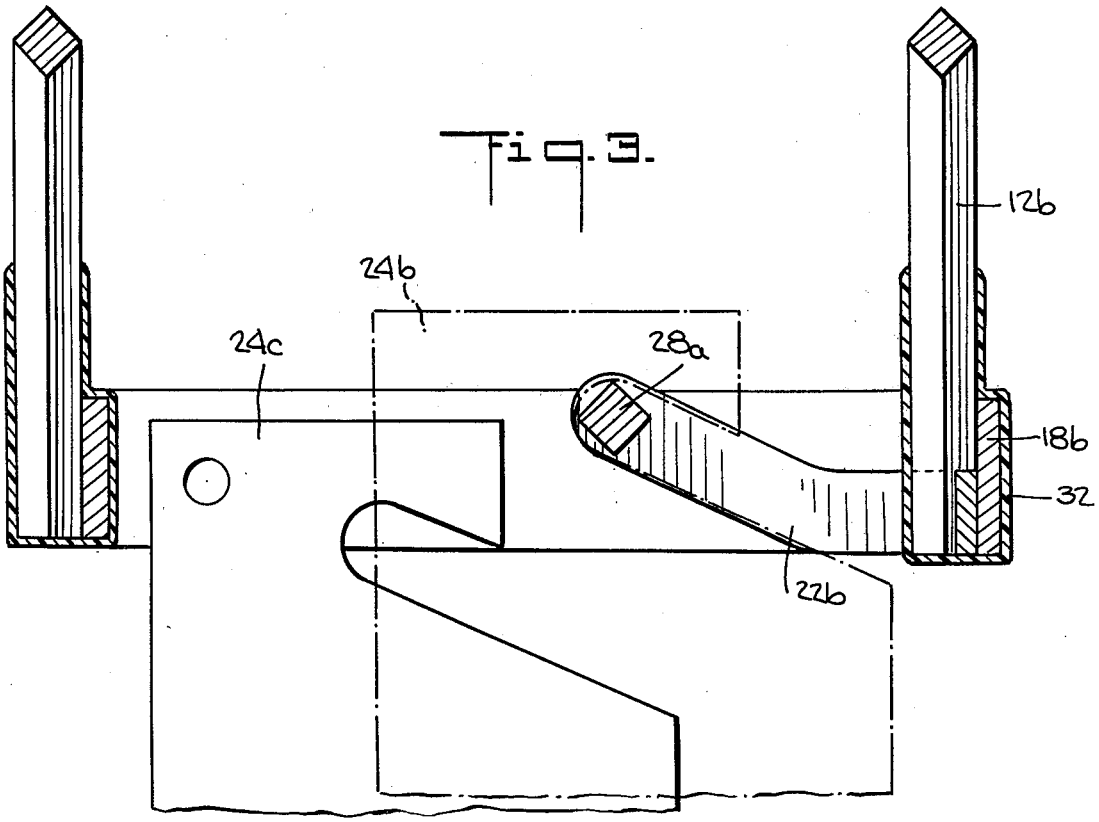

ELECTRODE AND SLUDGE COLLECTOR SUPPORT DEVICE AND ELECTROPLATING THEREWITH

BACKGROUND OF THE INVENTION

Field of Invention

This invention relates to electroplating, and more particularly, to a device used in an electroplating process. The device is adapted for conducting electrical current and supporting at least one electrode and sludge collector.

Background of the Invention

It is well known that soluble electrodes, such as nickel electrodes, are utilized in electroplating processes.

It is also well known that the standard commercial high purity nickel (99.9+% nickel) may be provided in the form of cathode sheets from an electrorefining operation. The sheets are usually about 26 inches×36 inches in major dimensions and are about $\frac{3}{8}$ inches thick. In electroplating, the standard size sheets must be sheared to provide smaller sizes because the standard size cannot conveniently be used.

In the past the sheets have been sheared into strips of about 4 inches wide or into 1 inch squares for use by electroplaters.

The squares, and, more recently, other small nickel bits, such as "rounds", are utilized by placement into baskets made of expanded titanium metal. The use of the basket and the squares or bits allows the electroplating procedure to operate continuously for all practical purposes. When the nickel bits or squares in the basket are depleted by the electroplating procedure, additional bits or squares can easily be added without removing the basket from the electroplating bath.

Presently, strips when used in electroplating are fixed to a support means by bolting or welding. When the strip is spent, the support means and the remains of the strip must be removed from the bath, requiring, at least, temporary interruption of the electroplating procedure.

Also, during electroplating procedures using either bits or strips, sludge is formed. To prevent contamination of the electroplating bath, a method for collecting the sludge must be utilized; customarily a bag is the method.

When squares or bits are used, the bag is slipped over the basket. By having the sludge collector over the basket, the sludge collector need not be removed from the bath when additional squares or bits are placed into the basket. When strips are used, the bags slip over the strip itself. Therefore, when the strip is removed from the bath, the bag must also be removed, producing handling problems.

There is presently a worldwide shortage of titanium which has raised the cost of the baskets. This has increased the overhead cost of electroplating with squares and bits. Additionally, electroplaters in undeveloped countries use strips predominantly and, therefore, cannot continuously electroplate.

It would be desirable to have a device which would permit a process which (1) could utilize electrode strip, (2) does not require expanded metal baskets and (3) could be operated continuously.

Summary of the Invention

A conductive electrode and sludge collector support device is provided that enables the immersing of an electrode and sludge collector into an electrolytic bath and which permits the removal of spent electrodes and subsequent replacement of electrode without the removal of the sludge collector from the bath.

The device is comprised of an open frame which supports a sludge collector, at least one attachment means for suspending the frame from a bus and a mounting means located within the frame for mounting at least one electrode.

BRIEF DESCRIPTION OF THE DRAWING

FIG. 2 is a upper plan view of the embodiment of FIG. 1.

FIG. 3 is a side elevation of the embodiment of FIG. 1 in partial cross-section.

DESCRIPTION OF THE PREFERRED EMBODIMENTS

Figure 1:
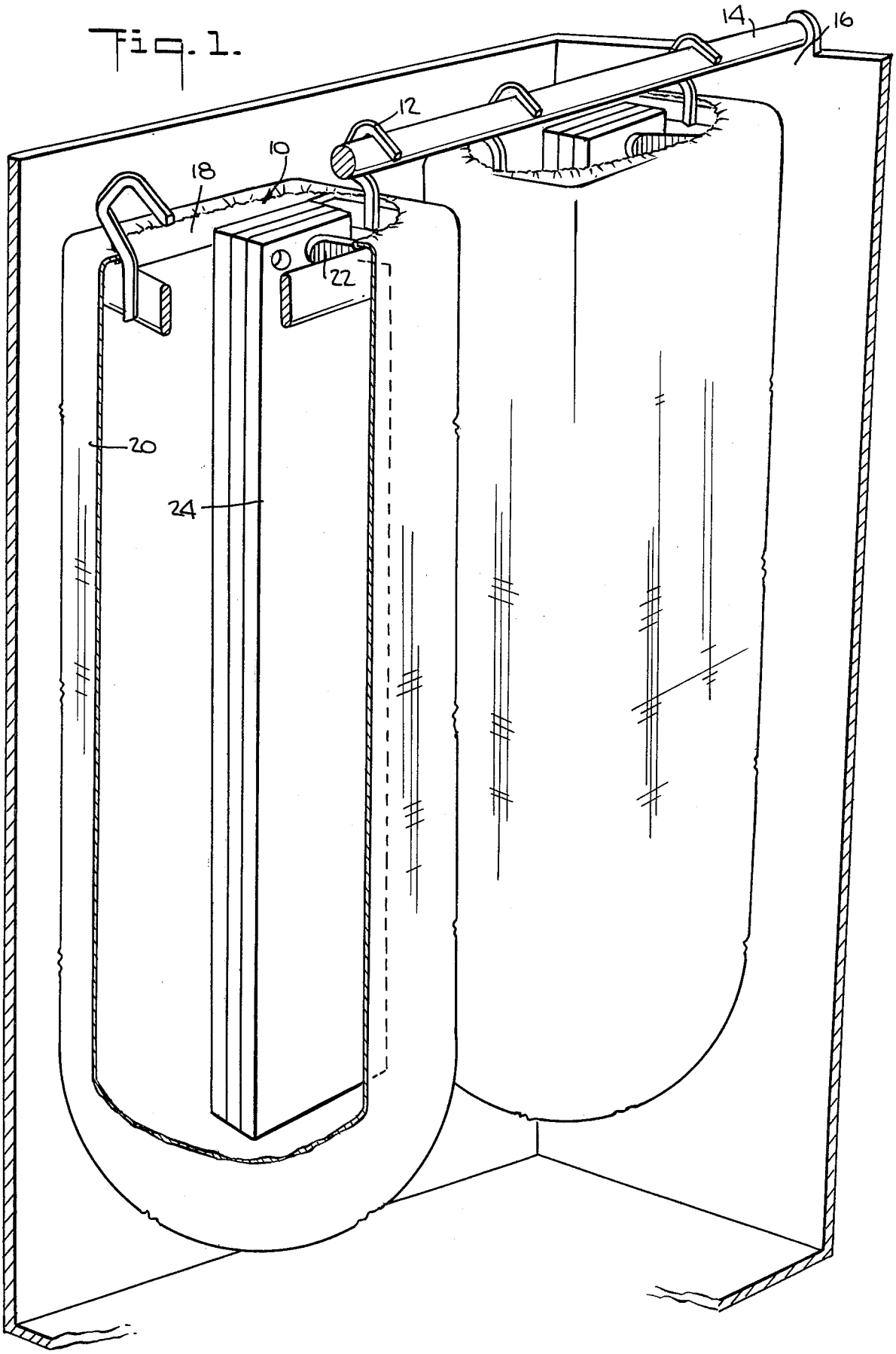
FIG. 1 is a partially open perspective view of an embodiment of the invention.

Referring now to FIG. 1, a preferred embodiment of the invention is shown in relationship with the electroplating apparatus with which the device will be utilized.

Device (10) is suspended by electrically conductive hooks (12) from a current conductive bus (14).

Conductive bus (14) is supported upon electroplating tank (16) which during the electroplating procedure is filled with an electrolytic solution (bath), not shown.

Hooks (12) are attached to a rectangular, electrically conductive frame (18). A sludge collector (20) is suspended from the frame (18).

Attached to the frame (18) is a U-shaped conductive brace (22). The brace has an electrically conductive rod (not shown) from which the electrode strip (24) may be hung. In the drawing three strips are shown. In the most preferred process using the device, at least two electrode strips are used. The electrode closest to the opposite polarity electrode is the one which is most quickly dissolved into the solution. This, therefore, preferably is the electrode first removed from the device. Preferably, when an electrode is placed upon the device, it will be positioned so as to be the electrode furthest from the opposite polarity electrode.

During the electroplating process the electrolyte solution is at a level which submerges substantially all the electrode strip and the sludge collector and permits the device (10) to be above the electrolyte solution.

FIG. 2 shows the preferred embodiment of FIG. 1 in more detail.

The conductive hooks (12*a*) are attached by welding to the frame or other suitable means (18*a*).

The U-shaped brace (22*a*) is conductively attached to the frame (18*a*) and supports a conductive rod (28) within the U.

The frame (18*a*) is dimensioned so that an electrode (24*a*) used in association with the device may be dismounted from or mounted upon a rod (28) when located at medial opening (30) and also be able to pass through lateral opening (26).

FIG. 3 shows the preferred embodiment of FIG. 1 in cross-sectional detail.

Hook (12*b*) is conductively attached to frame (18*b*). Frame (18*b*) and brace (22*b*) are coated with a corrosion resistant material (32). The brace (22*b*) is curved slightly upward.

Phantom electrode (24*b*) is shown mounted upon conductive rod (28*a*), while electrode (24*c*) is shown within the medial opening of the device.

Figure 4:
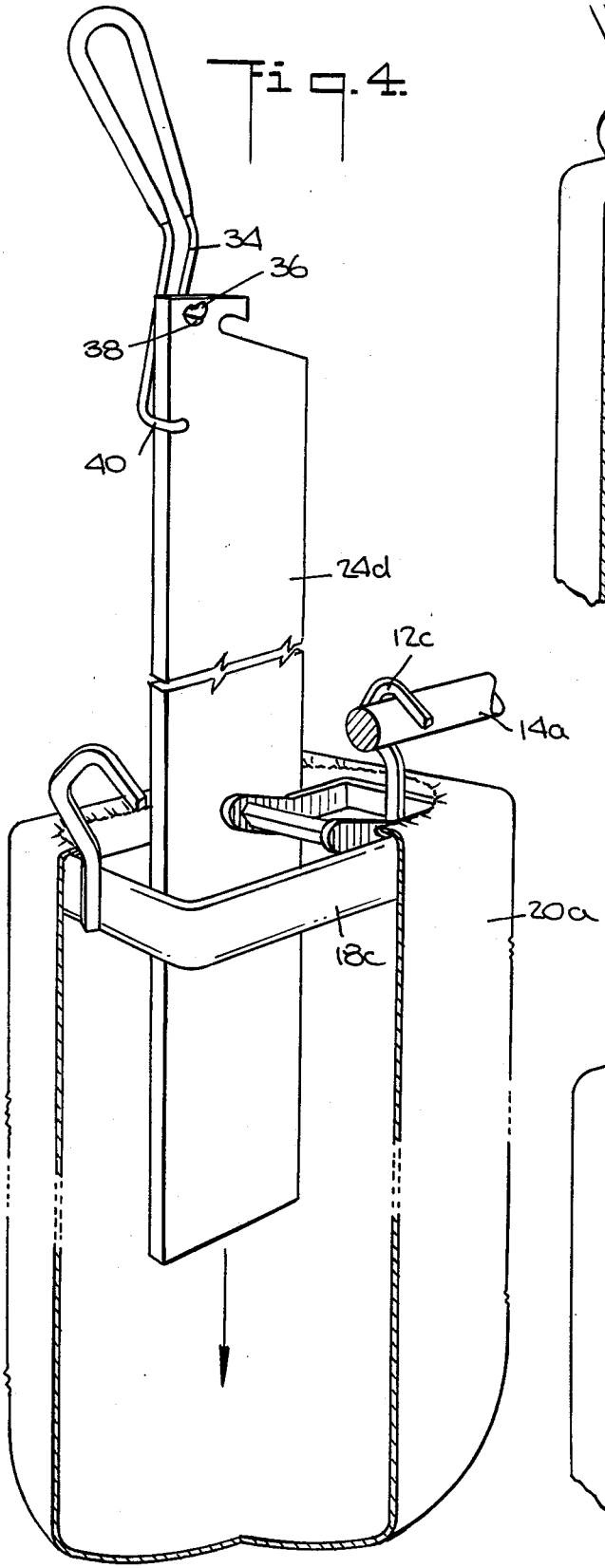
FIG. 4 is a partially open perspective view of the embodiment of FIG. 1.

FIG. 4 shows a device having a sludge collector (20*a*) placed on the frame (18*c*) and the hook (12*c*) placed over the bus (14*a*).

An electrode strip (24*d*) is being supported by a hand loading tool (34) which has one end (36) placed into a hole (38) in the strip. The other end (40) of the tool is shaped so as to supportively engage the edge of the strip. With the aid of the tool the electrode strip can be raised or lowered within the sludge collector and frame. The electrode is shown within the lateral opening.

Figure 5:
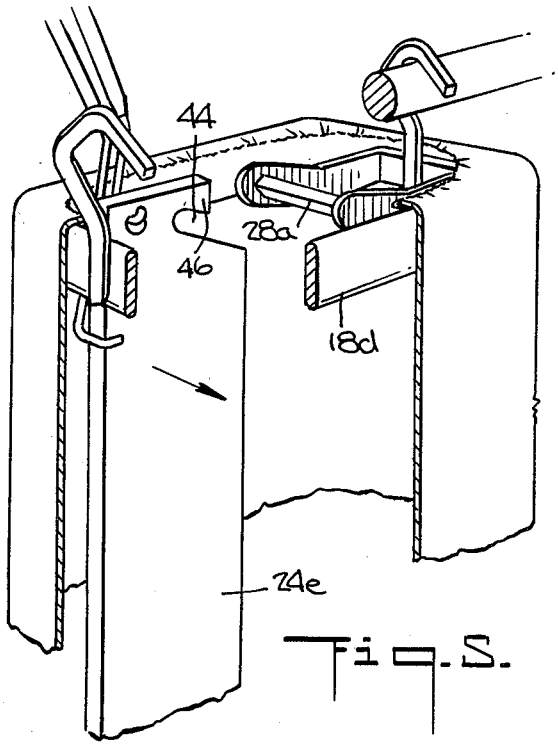
FIGS. 5 and 6 are partially open perspective views of the embodiment of FIG. 1.

As shown in FIG. 5, the electrode strip (24*e*) is lowered within the frame (18*d*) until the opening of notch (44) of the strip is approximately the level of the rod (28*a*).

The electrode is shown within the medial opening of the device. The portion of the electrode above the notch (46) has been reduced in width to enable passage of the strip into the medial opening of the device without requiring the frame to have excessive dimensions.

Figure 6:
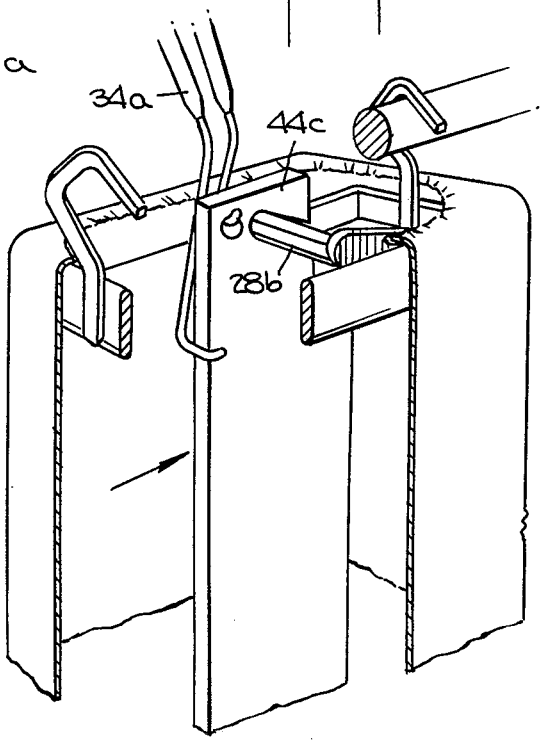

As shown in FIG. 6, the notch (44*c*) is then placed onto the rod (28*b*). The handling tool (34*a*) is then removed.

Figure 7:
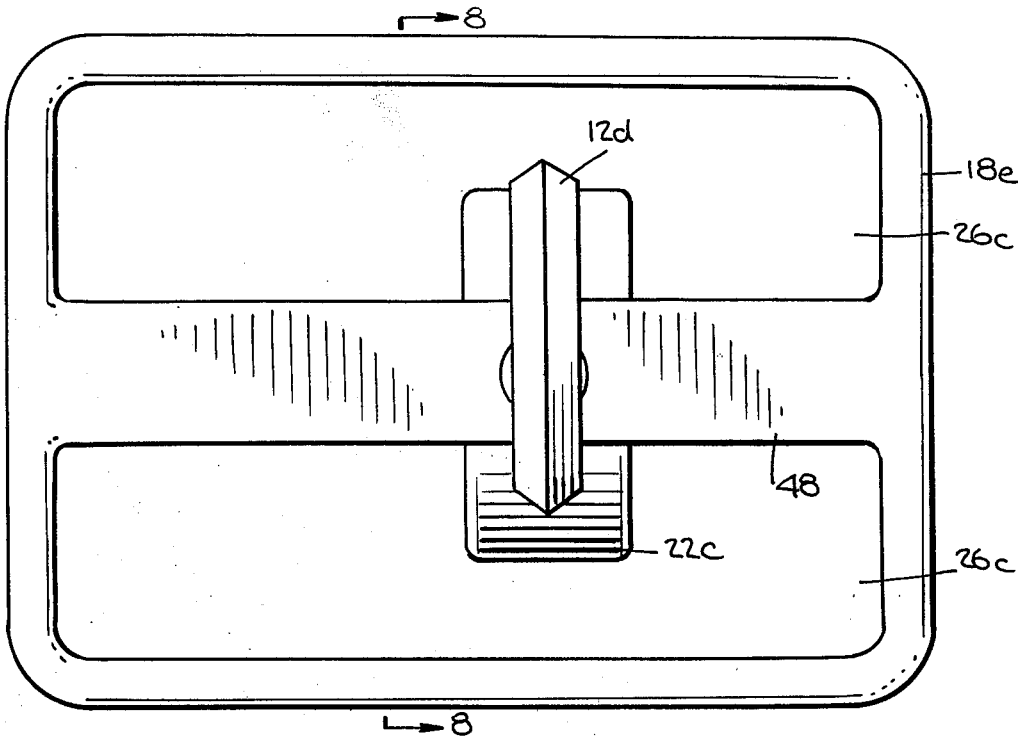
FIG. 7 is a upper plan view of another embodiment of the invention.

FIG. 7 shows another embodiment of the invention. The device has a rectangular frame (18*e*) which is not part of the conductive path and therefore can be made of a non-conductive material. The frame has a reinforcement bar (48) to which is attached conductive hook (12*d*) and brace (22*c*).

Lateral opening (26*c*) is on either side of the reinforcement bar (48).

Figure 8:
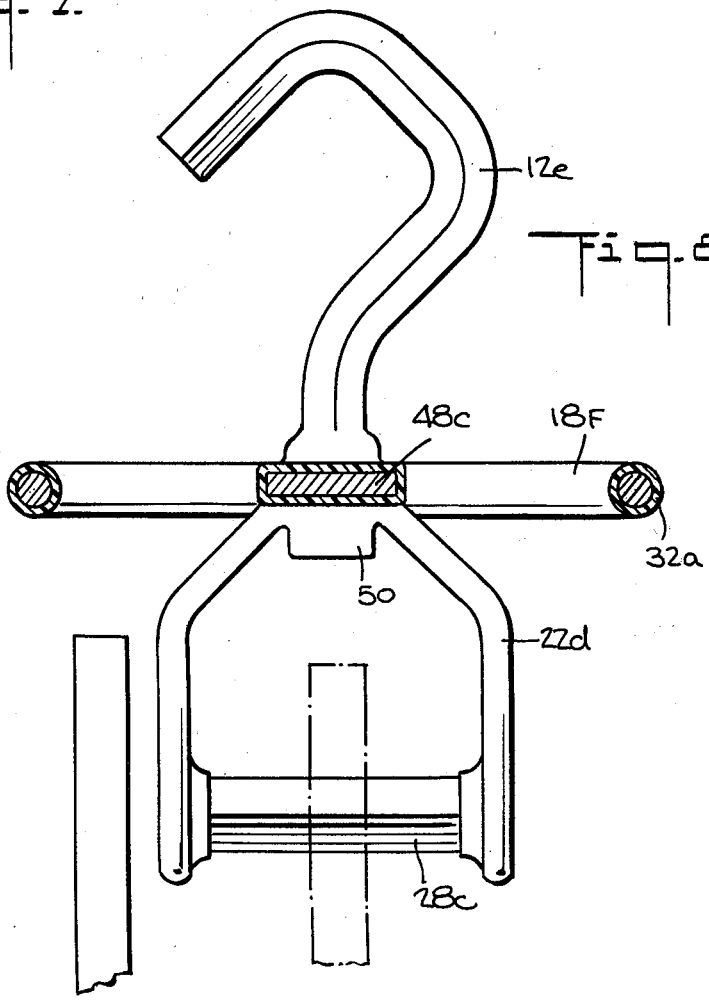
FIG. 8 is a cross-sectional view taken along line 8—8 of FIG. 7.

FIG. 8 is a cross-sectional view along line 8—8 of FIG. 7.

Frame (18*f*) reinforcement bar (48*c*) and brace (22*d*) have a corrosion resistant coat (32*a*). Hook (12*e*) and brace (22*d*) are attached to reinforcement bar (48*c*) by means of a screw nut (50).

Conductive rod (28*c*) is supported by the brace.

The device of the current invention is comprised of any material having sufficient strength to support the weight of the number of electrodes to be used.

The material must also be able to provide a conductive path through the device from the bus to the electrode. Additionally, the attachment means and the mounting means must have a conductive surface to transfer current from the bus to the device and from the device to the electrode respectively.

It is preferred, because the device will be used in a corrosive environment, that exposed portions of the device be of a corrosion resistant material.

Preferred corrosion resistant materials are the so-called valve metals well known in the field. They are much less expensive than the also useful platinum group metals and have properties which render them substantially corrosion resistant to the environments in electrolysis cells. Examples of suitable corrosion resistant valve metals are Ti, Ta, Nb, Hf, Zr, W, Al and alloys thereof. It is also well known to have the valve metal as a layer on a base metal such as copper which is a good conductor but may be corroded by the environment and such modifications are within the scope of this invention.

The portions of the device which are not required to be exposed to the environment may be of a less corrosion resistant material, however, they should be coated with a corrosion resistant material. These materials are well known in the art and include epoxy and plasticized polyvinyl chloride resins common referred to as "plastisol".

These corrosion resistant materials have good dielectric strength, are impervious to most acids and alkalies, have excellent abrasion resistance and will not contaminate the plating bath. It is preferred to coat as much of the device as possible.

The portions of the device which are not within the conductive path need not be of a conductive material.

In most plating operations, the electrode is a soluble anode which supplies the metal which is deposited upon the cathode.

The metals utilizable as soluble electrodes are well known in the art and include cadmium, copper, gold, iron, lead, zinc and nickel.

While the device can be utilized with any electrode metal, it is specifically adapted for use with nickel strip electrode.

The nickel which is used in the electroplating process of the current invention can be any available type used in electroplating.

This includes cast carbon nickel, rolled carbon nickel, rolled Depolarized*, electrolytic nickel and electrolytic nickel with added sulfur. Preferred is electrolytic nickel with added sulfur. (For example, S* electrolytic nickel sold by Inco*.)

(*Trademark of the Inco family of companies.)

The nickel electrode used with the device of the invention must be of a width and thickness which enables it to pass through a lateral opening in the frame. Preferred is a standard strip electrode known in the art.

The electrode will have associated with it a means for mounting the electrode onto the device. Preferably this means will be a notch. More preferably, the notch will slope downwardly, as indicated in the drawing, for ease of placement onto the electrode of the device.

The portion of the strip above the notch should be narrower than the portion of the strip below the notch. The narrower width will permit passage of the strip into the medial opening area of the frame for placement onto the rod without the frame requiring excessive dimensions.

The electrode preferably will also have associated with it a means to permit gripping the electrode to enable the electrode to be removed from and placed upon the device. Such means can include tabs spot-welded to the strip or a hole bored through the strip. These means increase the ease of handling the electrode when it is placed onto or removed from the device.

It is preferred to utilize a hand loading tool to remove and mount the electrode. The tool can be any that enhances ease of handling of the electrode by having a gripping means. One preferred embodiment is indicated in the drawings.

The device is suspended from a bus which is positioned so that when the device is suspended, the device, itself, will not have contact with the electrolyte solution.

The sludge collector and the electrode will be positioned so that a substantial portion of their length is submersed in the bath. A portion of the sludge collector and the electrode mounted or attached to the device shall be suspended above the electrolytic solution.

The electrolytic solution can be any of the bath solutions utilized in electroplating and known in the art. For example, for electroplating nickel, these baths include Watts, hard, chloride, chloride-sulfate, chloride-acetate, fluoroborate, sulfamate, sulfamate-chloride, nickel-cobalt nickel-iron and special purpose bath.

Since no soluble electrode dissolves without the formation of some sludge, a method for collecting the sludge must be used.

Most frequently, the sludge collector is a loose-fitting bag which will be slipped over the frame of the present invention.

Customarily the bags extend at least 2 to 4 inches below the bottom of the strip so that there is a pocket for falling sludge to collect it without insulating the end of the strip.

The material of the bag is usually a textile material which is woven closely enough to retain sludge without excessively restraining the passage of electrolyte.

Perferred textiles are plain cotton duck, nap flannel, muslin and various synthetics.

The sludge collector can be attached to the supporting frame by various means. A common means is to slip the sludge collector over the frame and to use a draw string to prevent slippage from the frame.

We claim:

1. An electrode holder adapted for use in electroplating with metal strip electrodes comprising a rectangular frame adapted to suspend an anode bag from the periphery thereof, a substantially horizontal current conducting bar adapted in use to suspend metal strip electrodes therefrom and to convey current to said electrodes, a suspending hook electrically connected to said current conducting bar, said bar being supported by said frame, said frame having in horizontal plane a lateral portion dimensioned to permit vertical passage of said strip electrodes thereinto, said strip electrodes having means in the upper portion thereof to engage said current conducting bar, whereby exhausted strip electrodes can be removed from said holder and new strip electrodes added without disturbing said holder or said anode bag.

2. The holder of claim 1 wherein the open interior portion of the frame has at least one lateral portion and a medial portion; and wherein the strip can pass into the lateral portion and be positioned in the medial portion prior to mounting upon the mounting means.

3. The holder of claim 2 wherein said rectangular frame supports a U-shaped brace having a conductive bar within the U from which to suspend said electrode strip.

4. The holder of claim 3 wherein the

U-shaped brace is positioned within and substantially in the same plane as the rectangular frame, wherein the brace divides the frame into three interior openings one being a medial opening and two being lateral openings.

5. The holder of claim 2 used in association with an electrode strip having a length substantially greater than its width, having a notch in the upper portion of the strip, wherein said notch can engage said current conducting bar, wherein the strip above the notch has a width smaller than the strip below the notch, and wherein the strip has a means for aiding gripping of the strip.

6. The holder of claim 5 wherein the electrode strip is comprised of nickel.

7. The holder of claim 6 wherein the electrode strip is comprised of electrolytic nickel with sulfur added.

8. An electroplating process comprising using as the anode an assembly of metal strip electrodes and a holder therefor, said holder comprising a rectangular frame adapted to suspend an anode bag from the periphery thereof, substantially horizontal current conducting means to convey current to said strip electrodes, and a suspending hook electrically connected to said current conducting means, with said frame supporting said current conducting means, said frame having in horizontal plane a lateral portion dimensioned to permit vertical passage of said strip electrodes thereinto, said strip electrodes having means in the top portion thereof adapted to engage said current conducting means, whereby exhausted strip electrodes may be removed from said holder and new electrodes added without disturbing said holder or said anode bag.

* * * * *